US009394594B2

(12) United States Patent
Bosch et al.

(10) Patent No.: US 9,394,594 B2
(45) Date of Patent: Jul. 19, 2016

(54) LOW ALLOY STEEL WITH A HIGH YIELD STRENGTH AND HIGH SULPHIDE STRESS CRACKING RESISTANCE

(75) Inventors: Christoph Bosch, Dortmund (DE); Axel Kulgemeyer, Krefeld (DE); Jean Leyer, Valenciennes (FR); Michel Piette, Valenciennes (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 307 days.

(21) Appl. No.: 13/203,905

(22) PCT Filed: Feb. 12, 2010

(86) PCT No.: PCT/EP2010/051803
§ 371 (c)(1),
(2), (4) Date: Aug. 30, 2011

(87) PCT Pub. No.: WO2010/100020
PCT Pub. Date: Sep. 10, 2010

(65) Prior Publication Data

US 2011/0315276 A1 Dec. 29, 2011

(30) Foreign Application Priority Data

Mar. 3, 2009 (FR) ..... 09 51326

(51) Int. Cl.
*C22C 38/26* (2006.01)
*C22C 38/22* (2006.01)

(52) U.S. Cl.
CPC ..... *C22C 38/26* (2013.01); *C22C 38/22* (2013.01)

(58) Field of Classification Search
CPC ..... C22C 38/04; C22C 38/18; C22C 38/26; C22C 38/22; C21D 1/32; C21D 8/06
USPC ..... 148/330; 420/69
See application file for complete search history.

(56) References Cited

U.S. PATENT DOCUMENTS

| | | | | |
|---|---|---|---|---|
| 5,938,865 | A | 8/1999 | Kondo et al. | |
| 6,488,787 | B1 * | 12/2002 | Ochi et al. | 148/330 |
| 2002/0104592 | A1 | 8/2002 | Sakamoto et al. | |
| 2008/0017284 | A1 | 1/2008 | Omura | |

FOREIGN PATENT DOCUMENTS

| | | | |
|---|---|---|---|
| CA | 2 695 688 | | 3/2009 |
| CA | 2 693 374 | | 4/2009 |
| EP | 0 828 007 | A | 3/1998 |
| EP | 1 197 571 | A | 4/2002 |
| EP | 1 862 561 | A | 12/2007 |
| EP | 2 133 443 | | 12/2009 |
| JP | S59-232220 | | 12/1984 |
| JP | H8-311551 | | 11/1996 |
| JP | 2006-265657 | | 10/2006 |
| WO | WO 2008/123425 | | 10/2008 |

OTHER PUBLICATIONS

International Search Report issued Jul. 27, 2010 in patent application No. PCT/EP2010/051803.
J.L. Battle, et al., "Resistance of Commercially Available High Strength Tubular Goods to Sulfide Stress Cracking", Asme Paper, No. 75-PET-40, Jan. 1, 1975, pp. 1-13.
N.T. Tikhontseva, et al., "Development of Steels and Heat Treatment Modes for Cold-Resistant and Hydrosulfide-Resistant High-Strength Pipes", Metal Science and Heat Treatment, Kluwer Academic Publishers-Plenum Publishers, vol. 49, No. 5-6, May 1, 2007, pp. 227-231.
A. Ikeda, et al., "On the Evaluation Method of Sulfide Stress Cracking Susceptibility of Carbon and Low Alloy Steels", Corrosion Science, vol. 27, No. 10-11, 1987, pp. 1099-1115.
Office Action issued May 28, 2014, in Canadian Patent Application No. 2,754,123.

* cited by examiner

*Primary Examiner* — Weiping Zhu
(74) *Attorney, Agent, or Firm* — Oblon, McClelland, Maier & Neustadt, L.L.P.

(57) ABSTRACT

A steel contains, by weight: C: 0.3% to 0.5%, Si: 0.1% to 0.5%, Mn: 0.1% to 1%, P: 0.03% or less, S: 0.005% or less, Cr: 0.3% to 1.5%, Mo: 1.0% to 1.5%, Al: 0.01% to 0.1%, V: 0.03% to 0.06%, Nb: 0.04% to 0.15%, Ti: 0 to 0.015%, N: 0.01% or less, the remainder of the chemical composition of the steel being constituted by Fe and impurities or residuals resulting from or necessary to steel production and casting processes. The steel enables to produce seamless tubes with a yield strength after heat treatment of 862 MPa or more which are particularly SSC-resistant.

25 Claims, 1 Drawing Sheet

K1SSC (MPa.m1/2)
YS (MPa)
50
45
40
35
30
25
20
860
880
900
920
940
960
B1
B2
C1
C2
D2
F

K1SSC (MPa.m1/2)
HRc
50
45
40
35
30
25
20
29
30
31
32
33
34
B1
B2
C1
C2
D2
F

LOW ALLOY STEEL WITH A HIGH YIELD STRENGTH AND HIGH SULPHIDE STRESS CRACKING RESISTANCE

The invention relates to low alloy steels with a high yield strength which have an excellent sulphide stress cracking behaviour. In particular, the invention is of application to tubular products for hydrocarbon wells containing hydrogen sulphide ($H_2S$).

Exploring and developing ever deeper hydrocarbon wells which are subjected to ever higher pressures at ever higher temperatures and in ever more corrosive media, in particular when loaded with hydrogen sulphide, means that the need to use low alloy tubes with both a high yield strength and high sulphide stress cracking resistance is ever increasing.

The presence of hydrogen sulphide, $H_2S$, is responsible for a dangerous form of cracking in low alloy steels with a high yield strength which is known as SSC (sulphide stress cracking) which may affect both casing and tubing, risers or drill-pipes and associated products. Hydrogen sulphide is also a gas which is fatal to man in doses of a few tens of parts per million (ppm). Sulphide stress cracking resistance is thus of particular importance for oil companies since it is of importance to the safety of both equipment and personnel.

The last decades have seen the successive development of low alloy steels which are highly resistant to $H_2S$ with minimum specified yield strengths which are getting higher and higher: 552 MPa (80 ksi), 621 MPa (90 ksi), 655 MPa (95 ksi) and more recently 758 MPa (110 ksi).

Today's hydrocarbon wells reach depths of several thousand metres and the weight of tube strings treated for standard levels of yield strength is thus very high. Further, pressures in the hydrocarbon reservoirs may be very high, of the order of several hundred bar, and the presence of $H_2S$, even at relatively low levels of the order of 10 to 100 ppm, results in partial pressures of the order of 0.001 to 0.1 bar, which are sufficient when the pH is low to cause SSC phenomena if the material of the tubes is not suitable. In addition, the use of low alloy steels combining a minimum specified yield strength of 862 MPa (125 ksi) with good sulphide stress cracking resistance would be particularly welcome in such strings.

For this reason, we sought to obtain a low alloy steel with both a minimum specified yield strength of 862 MPa (125 ksi) and good SSC behaviour, which is difficult since, as is well known, the SSC resistance of low alloy steels reduces as their yield strength increases.

Patent application EP-1 862 561 proposes a low alloy steel with a high yield strength (862 MPa or more) and excellent SSC resistance, disclosing a chemical composition which is advantageously associated with an isothermal bainitic transformation heat treatment in the temperature range 400-600° C.

In order to obtain a low alloy steel with a high yield strength, it is well known to carry out a quenching and tempering heat treatment at a relatively low temperature (less than 700° C.) on a Cr—Mo alloy steel. However, according to patent application EP-1 862 561, a low temperature temper encourages a high dislocation density and the precipitation of coarse $M_{23}C_6$ carbides at the grain boundaries, resulting in poor SSC behaviour. Patent application EP-1 892 561 thus proposes to improve the SSC resistance by increasing the tempering temperature to reduce the dislocation density and to limit the precipitation of coarse carbides at the grain boundaries by limiting the joint (Cr+Mo) content to a value in the range 1.5% to 3%. However, since there is then a risk that the yield strength of the steel will fall because of the high tempering temperature, patent application EP-1 862 561 proposes increasing the C content (between 0.3% and 0.6%) associated with sufficient addition of Mo and V (respectively 0.05% and 0.3% to 0.5% or more) to precipitate fine MC carbides.

However, there is then a risk that such an increase in the C content will cause quenching cracks with the conventional heat treatments (water quench+temper) which are applied, and so patent application EP-1 862 561 proposes an isothermal bainitic transformation heat treatment in the temperature range 400-600° C. which enables to prevent cracking during water quenching of steels with high carbon contents and also mixed martensite-bainite structures which are considered to be deleterious for SSC in the case of a milder quench, for example with oil.

The bainitic structure obtained (equivalent, according to EP-1 862 561, to the martensitic structure obtained by conventional quench+temper heat treatments) has a high yield strength (862 MPa or more or 125 ksi) associated with excellent SSC behaviour tested using NACE TM0177 methods A and D (National Association of Corrosion Engineers).

However, the industrial use of such an isothermal bainitic transformation requires very tight control of the treatment kinetics so that other transformations (martensitic or perlitic) are not triggered. Further, depending on the thickness of the tube, the quantity of water used for the quench varies, which means that tube-per-tube monitoring of the cooling rates is necessary in order to obtain a monophase bainitic structure.

The aim of the present invention is to produce a low alloy steel composition:

- which can be heat treated to produce a yield strength of 862 MPa (125 ksi) or more;
- with a SSC resistance, tested using NACE TM0177 specification methods A and D but with partial pressures of $H_2S$ of 0.03 bars (method A) and 0.1 bars or 1 bar (method D), which is excellent especially at the yield strengths indicated above;
- and which does not require the industrial installation of a bainitic quench, meaning that the production costs for seamless tubes would be lower than those associated with application EP-1 862 561.

In accordance with the invention, the steel contains, by weight:

C: 0.3% to 0.5%
Si: 0.1% to 0.5%
Mn: 0.1% to 1%
P: 0.03% or less
S: 0.005% or less
Cr: 0.3% to 1.5%
Mo: 1.0% to 1.5%
Al: 0.01% to 0.1%
V: 0.03% to 0.06%
Nb: 0.04% to 0.15%
Ti: at most 0.015%
N: 0.01% or less The remainder of the chemical composition of this steel is constituted by iron and impurities or residuals resulting from or necessary to steel production and casting processes.

IMPLEMENTATIONS OF THE INVENTION

Figure 1:
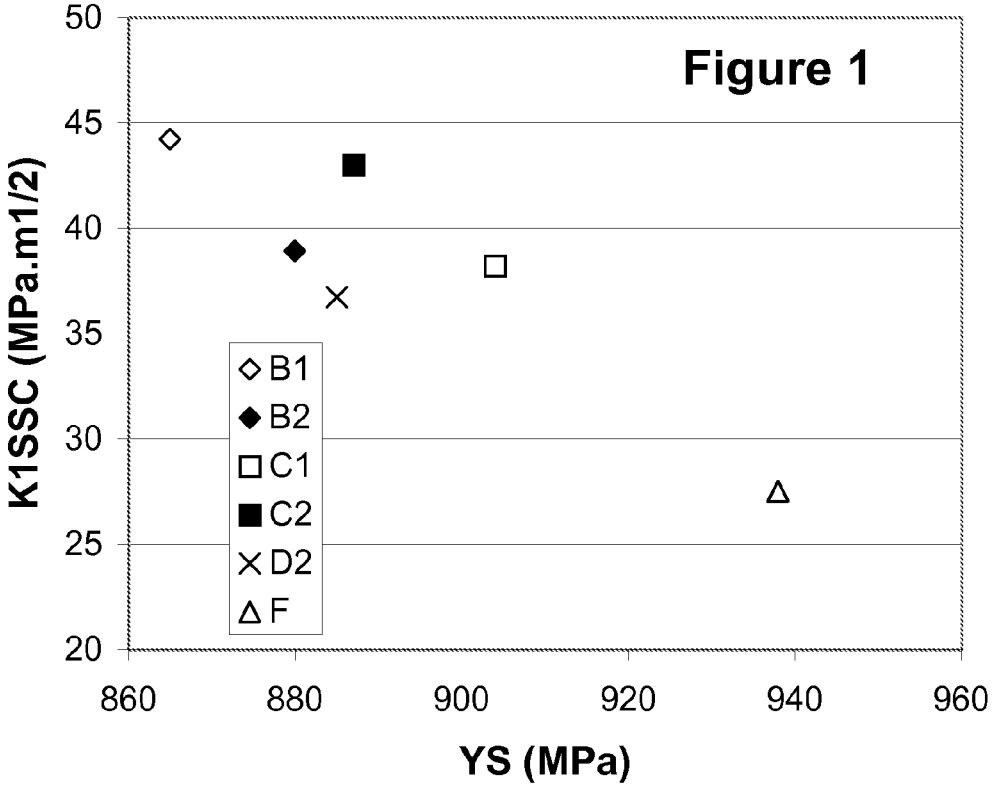
FIG. 1 is a diagram representing the variation in the stress intensity factor K1SSC as a function of the yield strength YS of steel specimens in accordance with the invention and outside the invention (comparative tests).

The influence of the elements of the chemical composition on the properties of the steel is as follows:

CARBON: 0.3% to 0.5%

The presence of this element is vital to improving the quenchability of the steel and enables the desired high performance mechanical characteristics to be obtained. A content of less than 0.3% could not produce the desired yield strength (125 ksi or more) after an extended tempering. On the other hand, if the carbon content exceeds 0.5%, the quantity of carbides formed would result in a deterioration in SSC resistance. For this reason, the upper limit is fixed at 0.5%. The preferred range is 0.3% to 0.4%, more preferably 0.3% to 0.36%.

SILICON: 0.1% to 0.5%

Silicon is an element which deoxidizes liquid steel. It also counters softening on tempering and thus contributes to improving SSC resistance. It must be present in an amount of at least 0.1% in order to have its effect. However, beyond 0.5%, it results in deterioration of SSC resistance. For this reason, its content is fixed to between 0.1% and 0.5%. The preferred range is 0.2% to 0.4%.

MANGANESE: 0.1% to 1%

Manganese is a sulphur-binding element which improves the forgeability of the steel and favours its quenchability. It must be present in an amount of at least 0.1% in order to have this effect. However, beyond 1%, it gives rise to deleterious segregation of the SSC resistance. For this reason, its content is fixed to between 0.1% and 1%. The preferred range is 0.2% to 0.5%.

PHOSPHORUS: 0.03% or less (impurity)

Phosphorus is an element which degrades SSC resistance by segregation at the grain boundaries. For this reason, its content is limited to 0.03% or less, and preferably to an extremely low level.

SULPHUR: 0.005% or less (impurity)

Sulphur is an element which forms inclusions which are deleterious to SSC resistance. The effect is particularly substantial beyond 0.005%. For this reason, its content is limited to 0.005% and preferably to an extremely low level, for example 0.003% or less.

CHROMIUM: 0.3% to 1.5%

Chromium is an element which is useful in improving the quenchability and strength of steel and increasing its SSC resistance. It must be present in an amount of at least 0.3% in order to produce these effects and must not exceed 1.5% in order to prevent deterioration of the SSC resistance. For this reason, its content is fixed to between 0.3% and 1.5%. The preferred range is in the range 0.6% to 1.2%, more preferably in the range 0.8% to 1.2%.

MOLYBDENUM: 1% to 1.5%

Molybdenum is a useful element for improving the quenchability of the steel and enables to increase the tempering temperature of the steel for a given yield strength. The inventors have observed a particularly favourable effect for Mo contents of 1% or more. However, if the molybdenum content exceeds 1.5%, it tends to favour the formation of coarse compounds after extended tempering to the detriment of SSC resistance. For this reason its content is fixed to between 1% and 1.5%. The preferred range is between 1.1% and 1.4%, more preferably between 1.2% and 1.4%.

ALUMINIUM: 0.01% to 0.1%

Aluminium is a powerful steel deoxidant and its presence also encourages the desulphurization of steel. It must be present in an amount of at least 0.01% in order to have its effect. However, this effect stagnates beyond 0.1%. For this reason, its upper limit is fixed at 0.1%. The preferred range is 0.01% to 0.05%.

VANADIUM: 0.03% to 0.06%

Like molybdenum, vanadium is an element which forms very fine micro-carbides, MC, which enable to delay tempering of the steel and thus to raise the tempering temperature for a given yield strength; it is thus a useful element in improving SSC resistance. It must be present in an amount of at least 0.03% (micro-alloy) in order to have this effect. However, it tends to embrittle the steel and the inventors have observed a deleterious influence on the SSC of steels with a high yield strength (more than 125 ksi for contents over 0.05%). For this reason, its content is fixed to between 0.03% and 0.06%. The preferred range is between 0.03% and 0.05%.

NIOBIUM: 0.04% to 0.15%

Niobium is a micro-alloying element which forms carbonitrides along with carbon and nitrogen. At the usual austenitizing temperatures, carbonitrides dissolve only very slightly and niobium has only a small hardening effect on tempering. In contrast, undissolved carbonitrides effectively anchor austenitic grain boundaries during austenitizing, thus allowing a very fine austenitic grain to be produced prior to quenching, which has a highly favourable effect on the yield strength and on the SSC resistance. The inventors also believe that this austenitic grain refining effect is enhanced by a double tempering operation. For the refining effect of niobium to be expressed, this element must be present in an amount of at least 0.04%. However, its effect stagnates beyond 0.15%. For this reason, its upper limit is fixed at 0.15%. The preferred range is 0.06% to 0.10%.

TITANIUM: 0.015% or less

A Ti content of more than 0.015% favours the precipitation of titanium nitrides, TiN, in the liquid phase of the steel and results in the formation of coarse angular TiN precipitates which are deleterious to SSC resistance. Ti contents of 0.015% or less may result from the production of liquid steel (constituting impurities or residuals) and not from deliberate addition and do not, according to the inventors, have a deleterious effect for limited nitrogen contents. In a similar manner to niobium, they can anchor austenitic grain boundaries during austenitizing even though such an effect is not useful since niobium is added for this purpose. For this reason the Ti content is limited to 0.015%, and preferably is kept to less than 0.005%.

NITROGEN: 0.01% or less (impurity)

A nitrogen content of more than 0.01% reduces the SSC resistance of steel, this element forming very fine nitride precipitates with vanadium and titanium which, however, are embrittling. Thus, it is preferably present in an amount of less than 0.01%.

BORON: not added

This nitrogen-greedy element enormously improves quenchability when it is dissolved in steel in amounts of a few ppm ($10^{-4}$%).

Micro-alloy boron steels generally contain titanium to bind nitrogen in the form of TiN compounds and leave the boron available.

An effective boron content can be defined as follows:

$$Beff=max(0\ ;B-max(0;\ 10(N/14-Ti/48)))$$

The functions max ( ) were introduced to avoid negative effective boron contents and amounts of nitrogen bound in the TiN form, which would have no physical meaning.

In the case of the present invention, the inventors found that for steels with a very high yield strength which must be resistant to SSC, adding effective boron was not useful or could even be deleterious.

The effective boron content is thus preferably selected to be 0.0003% or less, highly preferably equal to 0.

Example of an Embodiment

The products from twelve castings of steel (references A to L) were provided.

Castings A to F and J to L were industrial castings while castings G to I were experimental castings of a few hundred kg each.

Castings A to D and J to L had chemical compositions which were in accordance with the invention, while castings E to I were comparative examples which were outside the invention.

Table 1 below lists the composition of the tested castings (contents expressed as percentages by weight).

TABLE 1

Chemical composition of castings

| Ref | C | Si | Mn | P | S** | Cr | Mo | Ni | Al |
|---|---|---|---|---|---|---|---|---|---|
| Min | 0.30 | 0.1 | 0.1 | — | — | 0.3 | 1.0 | | 0.01 |
| Max | 0.50 | 0.5 | 1.0 | 0.03 | 0.005 | 1.5 | 1.5 | | 0.10 |
| A | 0.36 | 0.40 | 0.39 | 0.007 | 0.001 | 0.99 | 1.26 | 0.02 | 0.02 |
| B | 0.35 | 0.38 | 0.39 | 0.011 | ND | 0.94 | 1.27 | 0 | 0.04 |
| C | 0.35 | 0.35 | 0.38 | 0.012 | ND | 1.09 | 1.24 | 0 | 0.04 |
| D | 0.35 | 0.35 | 0.38 | 0.012 | ND | 1.09 | 1.24 | 0 | 0.04 |
| E* | 0.27* | 0.33 | 0.46 | 0.007 | 0.001 | 0.51* | 0.71* | 0.01 | 0.03 |
| F* | 0.26* | 0.31 | 0.48 | 0.011 | ND | 0.50* | 0.66* | 0.01 | 0.06 |
| G* | 0.32 | 0.31 | 0.37 | 0.011 | 0.001 | 1.00 | 0.86 | 0.06 | 0.02 |
| H* | 0.38 | 0.34 | 0.36 | 0.012 | 0.002 | 1.03 | 0.90 | 0.05 | 0.02 |
| I* | 0.42 | 0.34 | 0.36 | 0.012 | 0.002 | 1.03 | 0.92 | 0.06 | 0.03 |
| J | 0.34 | 0.34 | 0.35 | 0.006 | 0.001 | 0.97 | 1.24 | 0.01 | 0.02 |
| K | 0.34 | 0.35 | 0.37 | 0.009 | ND | 0.97 | 1.19 | 0.01 | 0.04 |
| L | 0.34 | 0.33 | 0.37 | 0.005 | ND | 0.98 | 1.26 | 0.01 | 0.03 |

| Ref | Nb | V | Ti | N | B | B eff | $O_T$ |
|---|---|---|---|---|---|---|---|
| Min | 0.04 | 0.03 | — | — | | | |
| Max | 0.15 | 0.06 | 0.015 | 0.010 | | | |
| A | 0.08 | 0.05 | 0.003 | 0.007 | 0.0010 | 0 | |
| B | 0.08 | 0.06 | 0.013 | 0.005 | 0.0006 | 0 | 0.001 |
| C | 0.08 | 0.07 | 0.013 | 0.006 | 0.0006 | 0 | 0.001 |
| D | 0.08 | 0.07 | 0.013 | 0.006 | 0.0006 | 0 | 0.001 |
| E* | 0.02* | 0.10* | 0.025* | 0.006 | 0.0010 | 0.0010* | |
| F* | 0.01* | 0.10* | 0.018* | 0.003 | 0.0013 | 0.0013* | |
| G* | 0.03* | 0.05 | — | 0.005 | — | 0 | |
| H* | 0* | 0.07 | 0.002 | 0.003 | ND | 0 | |
| I* | 0.08 | 0.05 | 0.002 | 0.006 | ND | 0 | |
| J | 0.08 | 0.04 | 0.002 | 0.005 | 0.0001 | 0 | 0.001 |
| K | 0.08 | 0.06 | 0.003 | 0.005 | 0.0006 | 0 | |
| L | 0.08 | 0.05 | 0.003 | 0.004 | 0.0001 | 0 | 0.002 |

*comparative example; contents outside invention

**ND for element S means a content of 0.0011% or less and for element B means a content of 0.0003% or less Note the low total oxygen ($O_T$) concentrations in the steel of the invention.

Billets from castings A to G and J to L were transformed by hot rolling into seamless tubes defined by their external diameter and thickness. Casings with a thickness of approximately 15 mm were obtained as well as 30 mm thick blanks (coupling stock) for coupling said casings together.

We have distinguished between the various products from a single casting by a numerical index (for example J1, J2, J3).

Castings H and I, which were outside the present invention, were hot rolled into 27 mm thick plates.

All of these products (tubes, plates) were heat treated by water quench (oil in the case of tubes from casting A) between 900° C. and 940° C. and tempered close to 700° C. to produce a yield strength of 862 MPa (125 ksi) or more. Several successive quench operations (2 or 3) were employed, in particular to refine the grain size. Depending on the case, a temper could be carried out between two quench operations to avoid generating cracks between said operations.

Following quenching, the tubes of the invention had a substantially entirely martensitic structure (possibly with traces of bainite) as confirmed by micrographical examinations of the hardness measurements carried out in the as quenched state in Table 2 below.

TABLE 2

HRc hardness measurements after double water quench

| Ref | Dimensions Diameter × thickness | HRc measurements in as quenched state | | |
|---|---|---|---|---|
| | | Outer skin | Half thickness | Internal skin |
| B1 | Tube 244.5 × 13.84 mm | 55.2 | 56.6 | 55.9 |
| B2 | Tube 273.1 × 30 mm | 56.8 | 57.2 | 54.9 |
| C1 | Tube 244.5 × 13.84 mm | 58.3 | 58.5 | 57.0 |
| C2 | Tube 273.1 × 30 mm | 57.7 | 57.1 | 56.6 |
| D1 | Tube 244.5 × 13.84 mm | 57.7 | 58.1 | 58.6 |
| D2 | Tube 273.1 × 30 mm | 56.6 | 56.8 | 53.1 |
| J1 | Tube 273.1 × 20.24 mm | 53.8 | 52.7 | 53.5 |

The production of a purely martensitic structure for the steel of the invention was further corroborated by its hardenability (Jominy) curve. For the steel of the invention, the curve was flat, at approximately 53 HRc up to a distance of 15 mm from the quenched end of the specimen.

It was estimated that such quenchability could enable to obtain an entirely martensitic structure for a tube of 50 mm quenched with water (external and internal quench).

The size of the austenitic grains obtained for the steel tubes of the invention was very fine: 11 to 12 for casing tubes B1, C1, D1; 12 with a few coarser grains for the coupling stock B2, C2, D2 (measurements in accordance with specification ASTM E112).

Table 3 indicates the dimensional characteristics of the products as well as the yield strength and break strength obtained after heat treatment of the steel of the invention. The values for the yield strength obtained are distributed between 865 and 959 MPa (125 to 139 ksi).

The mean values for the steel castings of the invention and outside the invention were respectively 906 and 926 MPa (131 and 134 MPa) and were not significantly different.

TABLE 23

Tensile properties after heat treatment

| Ref | Product and dimensions Diameter × thickness or thickness (mm) | Heat treatment (**) | Yield strength MPa (ksi) | Ultimate Tensile Strength MPa (ksi) |
|---|---|---|---|---|
| A | Tube 244.5 × 13.84 mm | OQ + T + OQ + T + OQ + T | 923 (134) | 972 (141) |
| B1 | Tube 244.5 × 13.84 mm | WQ + T + WQ + T | 865 (125) | 944 (137) |
| B2 | Tube 273.1 × 30 mm | WQ + T + WQ + T + WQ + T | 880 (128) | 947 (137) |
| Cl | Tube 244.5 × 13.84 mm | WQ + T + WQ + T | 904 (131) | 982 (142) |
| C2 | Tube 273.1 × 30 mm | WQ + T + WQ + T + WQ + T | 887 (129) | 951 (138) |
| D1 | Tube 244.5 × 13.84 mm | WQ + T + WQ + T | 918 (133) | 1002 (145) |
| D2 | Tube 273.1 × 30 mm | WQ + T + WQ + T + WQ + T | 885 (128) | 962 (140) |

TABLE 23-continued

| Tensile properties after heat treatment | | | | |
|---|---|---|---|---|
| Ref | Product and dimensions Diameter × thickness or thickness (mm) | Heat treatment (**) | Yield strength MPa (ksi) | Ultimate Tensile Strength MPa (ksi) |
| E* | Tube 244.5 × 13.84 mm | WQ + T + WQ + T | 931 (135) | 985 (143) |
| F* | Tube 254 × 18 mm | | 938 (136) | 1007 (146) |
| G* | Tube 157.2 × 15.2 mm | WQ + WQ + T | 920 (133.4) | 998 (144.7) |
| H* | Rolled plate 27 mm | WQ + WQ + T | 920 (134) | 1012 (146.8) |
| I* | Rolled plate 27 mm | WQ + WQ + T | 921 (133.6) | 984 (142.7) |
| J1 | Tube 273.1 × 20.24 mm | WQ + T + WQ + T | 893 (129.4) | 971 (140.8) |
| J2 | Tube 273.1 × 20.24 mm | WQ + T + WQ + T + WQ + T | 959 (139) | 1018 (148) |
| J3 | Tube 273.1 × 20.24 mm | WQ + T + WQ + T | 889 (129) | 958 (139) |
| K | Tube 273.1 × 20.24 mm | WQ + T + WQ + T | 910 (132) | 972 (141) |
| L1 | Tube 273.1 × 20.24 mm | WQ + T + WQ + T + WQ + T | 932 (135) | 1026 (149) |
| L2 | Tube 273.1 × 20.24 mm | WQ + T + WQ + T | 931 (135) | 1000 (145) |

*comparative example

**WQ = water quench; OQ = oil quench; T = temper

Uniaxial SSC Tensile Test

Tables 4 and 5 show the results of tests to determine the SSC resistance using method A of specification NACE TM0177 but with a reduced $H_2S$ content (3%) in the test solution.

The test specimens were cylindrical tensile specimens taken longitudinally at half the thickness from the tubes (or plates) shown in Table 3 and machined in accordance with method A of specification NACE TM0177.

The test bath used was of the EFC 16 type (European Federation of Corrosion). It was composed of 5% sodium chloride (NaCl) and 0.4% sodium acetate ($CH_3COONa$) with a 3% $H_2S$/97% $CO_2$ gas mixture bubbled through continuously at 24° C. (±3° C.) and adjusted to a pH of 3.5 using hydrochloric acid (HCl) in accordance with ISO standard 15156.

The loading stress was fixed to a given percentage X of the specified minimum yield strength (SMYS), i.e. X % of 862 MPa. Three specimens were tested under the same test conditions to take into account the relative dispersion of this type of test.

The SSC resistance was judged to be good in the absence of breakage of three specimens after 720 h (result=3/3) and insufficient or poor if breakage occurred before 720 h in the calibrated portion of at least one specimen out of the three test pieces (result=0/3, 1/3 or 2/3).

The loading stress was fixed at 85% of the specified minimum yield strength (SMYS), i.e. 733 MPa (106 ksi) for the tests of Table 4.

The results obtained for all of the steel references in accordance with the invention (A to D and J, L) as well as for the comparative steel F were good; those for comparative steels E and I were inferior.

The thickness of the tubes was not observed to have any influence (compare B1/B2, C1/C2 and D1/D2).

TABLE 4

| SSC method A tests, 85% SMYS | | | | |
|---|---|---|---|---|
| | Nace test method A | | | |
| | Environment | | | |
| Ref | pH | $H_2S$ (%) | Applied load | Result >720 h |
| A | 3.5 | 3 | 85% SMYS | 3/3 |
| B1 | 3.5 | 3 | 85% SMYS | 3/3 |
| B2 | 3.5 | 3 | 85% SMYS | 3/3 |
| C1 | 3.5 | 3 | 85% SMYS | 3/3 |
| C2 | 3.5 | 3 | 85% SMYS | 3/3 |
| D1 | 3.5 | 3 | 85% SMYS | 3/3 |
| D2 | 3.5 | 3 | 85% SMYS | 3/3 |
| E* | 3.5 | 3 | 85% SMYS | 2/3 |
| F* | 3.5 | 3 | 85% SMYS | 3/3 |
| I* | 3.5 | 3 | 85% SMYS | 0/3 |
| J2 | 3.5 | 3 | 85% SMYS | 3/3 |
| L1 | 3.5 | 3 | 85% SMYS | 3/3 |

*comparative example

The loading stress was fixed at 90% of the specified minimum yield strength (SMYS), i.e. 775 MPa (113 ksi) for the tests of Table 5.

The results obtained for all of the steels in accordance with the invention (A to D and J3 to L) as well as for the comparative steel F were excellent; that for steel J1 was limited (1 break just before 720 h); that for comparative steels G and H were notably poor (time to break between 187 and 370 h).

TABLE 5

| SSC method A tests, 90% SMYS | | | | |
|---|---|---|---|---|
| | Nace test method A | | | |
| | Environment | | | |
| Ref | pH | $H_2S$ (%) | Applied stress | Result >720 h |
| B1 | 3.5 | 3 | 90% SMYS | 3/3 |
| B2 | 3.5 | 3 | 90% SMYS | 3/3 |
| C1 | 3.5 | 3 | 90% SMYS | 3/3 |
| C2 | 3.5 | 3 | 90% SMYS | 3/3 |
| Dl | 3.5 | 3 | 90% SMYS | 3/3 |
| D2 | 3.5 | 3 | 90% SMYS | 3/3 |
| F* | 3.5 | 3 | 90% SMYS | 3/3 |
| G* | 3.5 | 3 | 90% SMYS | 0/3 |
| H* | 3.5 | 3 | 90% SMYS | 0/3 |
| J1 | 3.5 | 3 | 90% SMYS | 2/3 |
| J3 | 3.5 | 3 | 90% SMYS | 3/3 |
| K | 3.5 | 3 | 90% SMYS | 3/3 |
| L2 | 3.5 | 3 | 90% SMYS | 3/3 |

*comparative example

K1SSC Tests

The test specimens were chevron notch DCB (double cantilever beam) specimens taken from the tubes shown in Table 3 in the longitudinal direction at half thickness and machined in accordance with specification NACE TM0177 method D.

The test bath used in the first series of tests was an aqueous solution composed of 50 g/l of sodium chloride (NaCl) and 4 g/l of sodium acetate ($CH_3COONa$) saturated with $H_2S$ before the test by bubbling through a mixture of 10% $H_2S$/90% $CO_2$ gas at atmospheric pressure and at 24° C. (±1.7° C.) and adjusted to a pH of 3.5 using hydrochloric acid (HCl) (tests termed mild condition tests).

The specimens were placed under tension using a wedge which imposed a displacement of the 2 arms of the DCB specimen of 0.51 mm (±0.03 mm) and subjected to the test solution for 14 days.

They were then broken under tension. The critical lift off load for the wedge was measured and on the ruptured surfaces, the mean crack propagation length when maintained in the test solution was measured and the critical stress intensity for SSC was measured: the K1SSC. Additional criteria were used to ensure the validity of the determination.

Three specimens were tested per product in order to account for the dispersion of this test; the mean value and standard deviation of these three determinations were determined.

Table 6 below shows the K1SSC results obtained for the specimens and the HRc hardness measurements carried out before introduction into the SSC test solution at half the width of the specimen in front of the chevron notch in accordance with standards ISO11960 or API 5CT, latest edition. Table 6 also shows the values for the yield strength of Table 3.

TABLE 6

Results of K1SSC test under mild conditions and HRc hardness test.

| Ref | Yield strength (MPa) | K1SSC (MPa · $m^{1/2}$) Individual value | Mean | Standard deviation | HRc specimen |
|---|---|---|---|---|---|
| B1 | 865 | 46.6 | 44.2 | 2.1 | 30.0 |
| | | 43.2 | | | 29.9 |
| | | 42.7 | | | 29.6 |
| B2 | 880 | 40.2 | 38.9 | 1.2 | 31.2 |
| | | 37.7 | | | 31.3 |
| | | 38.8 | | | 30.9 |
| C1 | 904 | 39.9 | 38.2 | 1.9 | 31.1 |
| | | 36.2 | | | 31.2 |
| | | 38.4 | | | 31.7 |
| C2 | 887 | 41.2 | 43.0 | 1.5 | 31.6 |
| | | 43.7 | | | 31.7 |
| | | 44.0 | | | 31.4 |
| D2 | 885 | 39.1 | 36.7 | 2.2 | 29.4 |
| | | 36.5 | | | 31.7 |
| | | 34.6 | | | 31.5 |
| F* | 938 | 26.3 | 27.5 | 1.1 | 33.1 |
| | | 28.4 | | | 33.0 |
| | | 27.9 | | | 33.0 |

*comparative example

The individual values for K1SSC were from 34.6 to 46.6 MPa·$m^{1/2}$ for the steel of the invention and were substantially lower for steel F, outside the invention.

The format of the tube (thickness 13.84 or 30 mm) was not observed to have any particular influence.

Figure 2:
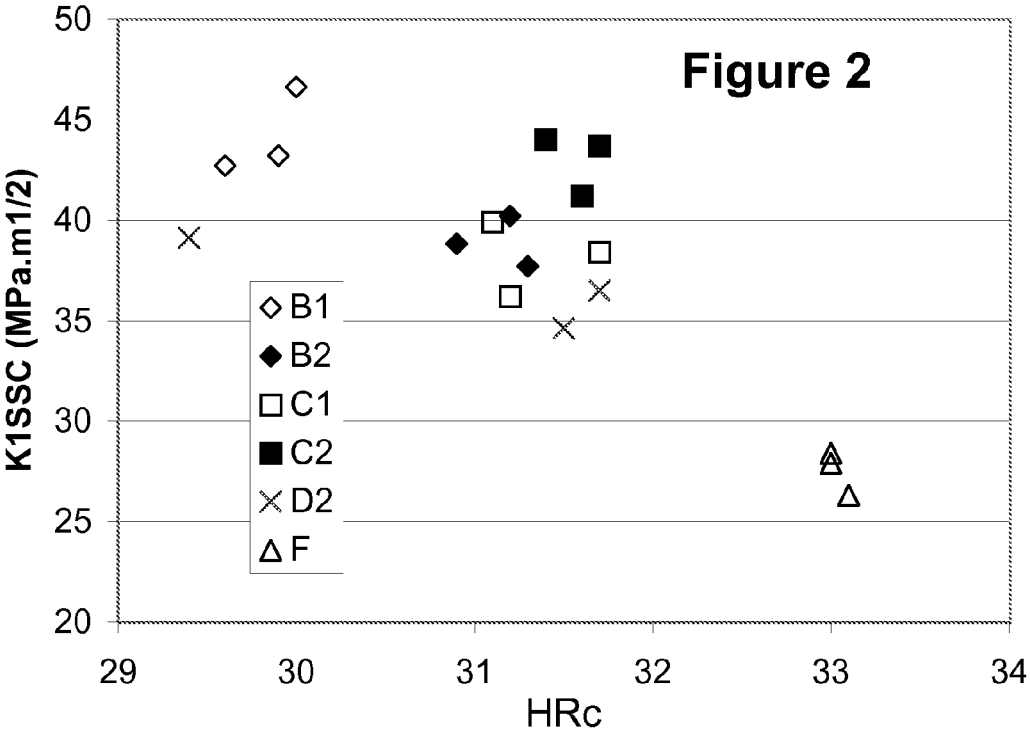
FIG. 2 is a diagram representing the variation in the stress intensity factor K1SSC as a function of the mean hardness HRc of steel specimens in accordance with the invention and outside the invention (comparative tests).

The mean K1SSC values are shown as a function of the yield strength (YS) in FIG. 1 and the individual values of K1SSC are shown as a function of the mean hardness HRc of the specimen of FIG. 2.

The value of K1SSC tended to reduce with the yield strength or the hardness.

However, above all, if the relationship with the hardness HRc (FIG. 2) is considered, it appears that for a given hardness, higher values for K1SSC were obtained with the steel of the invention (compared with specimens B, C, D to F).

Thus, it appears to be preferable to treat the steel in a range of values with a yield strength in the range 862 to 965 MPa (125-140 ksi) and more preferably in the range 862 to 931 MPa (125-135 ksi).

In a second series of tests, the DCB specimens were tested under more severe conditions termed "full NACE" conditions. They were immersed in a solution which was similar to the preceding one except that it had been saturated with a gas containing 100% of $H_2S$ (as opposed to 10% for the tests of the first series) and that the pH had been adjusted to 2.7. The displacement of the arms of the specimen was fixed at 0.38 mm.

The results are shown in Table 7.

The K1SSC values obtained were of the order of 24 MPa·$m^{1/2}$, substantially lower than under the mild test conditions. The same type of classification was obtained as under mild conditions (the steel of the invention produces better results than the comparative grade F).

The steel of the invention is of particular application to products intended for exploration and the production from hydrocarbon fields such as casing, tubing, risers, drill strings, drill collars or even accessories for the above products.

TABLE 7

Results of K1SSC test under "full NACE" conditions and hardness test.

| Ref | Yield strength (MPa) | K1SSC (MPa · $m^{1/2}$) Individual value | Mean | Standard deviation |
|---|---|---|---|---|
| B2 | 880 | 24.9 | 24.4 | 1.3 |
| | | 23.1 | | |
| | | 25.9 | | |
| | | 23.5 | | |
| C2 | 887 | 23.0 | 23.9 | 0.6 |
| | | 24.3 | | |
| | | 24.2 | | |
| | | 24.1 | | |
| D2 | 885 | 23.9 | 23.9 | 0.8 |
| | | 24.9 | | |
| | | 23.4 | | |
| | | 23.2 | | |
| F* | 938 | 19.5 | 21.0 | 1.3 |
| | | 21.7 | | |
| | | 21.8 | | |

*comparative example

The invention claimed is:

1. A low alloy steel, comprising Fe, impurities or residuals from production or casting, and, by weight:

C: 0.3% to 0.5%;
Si: 0.2% to 0.5%;
Mn: 0.1% to 1%;
P: 0.03% or less;
S: 0.005% or less;
Cr: 0.3% to 1.5%;
Mo: 1.1% to 1.5%;
Al: 0.01% to 0.1%;
V: 0.03% to 0.06%;
Nb: 0.04% to 0.15%;
Ti: 0 to 0.015%; and
N: 0.01% or less,
wherein the steel consists of a martensitic structure.

2. The steel of claim 1, wherein the C content is in a range 0.3% to 0.4%.

3. The steel of claim 2, wherein the Mn content is in a range 0.2% to 0.5%.

4. The steel of claim 2, wherein the Cr content is in a range 0.6% to 1.2%.

5. The steel of claim 2, wherein the Mo content is in a range 1.1% to 1.4%.

6. The steel of claim 1, wherein the Mn content is in a range 0.2% to 0.5%.

7. The steel of claim 6, wherein the Cr content is in a range 0.6% to 1.2%.

8. The steel of claim 6, wherein the Mo content is in a range 1.1% to 1.4%.

9. The steel of claim 1, wherein the Cr content is in a range 0.6% to 1.2%.

10. The steel of claim 9, wherein the Mo content is in a range 1.1% to 1.4%.

11. The steel of claim 1, wherein the Mo content is in a range 1.1% to 1.4%.

12. The steel of claim 1, wherein the S content is 0. 003% or less.

13. The steel of claim 1, wherein the Al content is in a range 0.01% to 0.05%.

14. The steel of claim 1, wherein the V content is in a range 0.03% to 0.05%.

15. The steel of claim 1, wherein the Nb content is in a range 0.06% to 0.10%.

16. The steel of claim 1, wherein an effective boron content is zero, the effective boron content being equal to:

$$Beff=max(0; B-max(0; 10(N/14-Ti/48))).$$

17. The steel of claim 1, wherein the Si content is in a range 0.2% to 0.4%.

18. The steel of claim 1, wherein the Cr content is in a range 0.8% to 1.2%.

19. The steel of claim 1, wherein the steel has a yield strength of at least 862 MPa.

20. The steel of claim 19, wherein the steel has a yield strength of 959 MPa or less.

21. The steel of claim 1, wherein if B is present in the steel, B is present in an amount of 0.0003% or less.

22. A low alloy steel, comprising Fe, impurities or residuals from production or casting, and, by weight:

C: 0.3% to 0.5%;
Si: 0.2% to 0.5%;
Mn: 0.1% to 1%;
P: 0.03% or less;
S: 0.005% or less;
Cr: 0.3% to 1.5%;
Mo: 1.1% to 1.5%;
Al: 0.01% to 0.1%;
V: 0.03% to 0.06%;
Nb: 0.04% to 0.15%;
Ti: 0 to 0.015%; and
N: 0.01% or less.

23. The steel of claim 22, wherein the steel has a substantially entirely martensitic structure after heat treatment comprising quenching.

24. The steel of claim 22, which is heat treated so that a yield strength of the steel is 862 MPa (125 ksi) or more.

25. The steel of claim 24, wherein the heat treatment comprises at least two quenching operations.

* * * * *